US008369555B2

(12) United States Patent
Fazzio et al.

(10) Patent No.: US 8,369,555 B2
(45) Date of Patent: Feb. 5, 2013

(54) PIEZOELECTRIC MICROPHONES

(75) Inventors: R. Shane Fazzio, Loveland, CO (US); Atul Goel, Fort Collins, CO (US)

(73) Assignee: Avago Technologies Wireless IP (Singapore) Pte. Ltd., Singapore (SG)

( * ) Notice: Subject to any disclaimer, the term of this patent is extended or adjusted under 35 U.S.C. 154(b) by 1262 days.

(21) Appl. No.: 11/588,752

(22) Filed: Oct. 27, 2006

(65) Prior Publication Data

US 2008/0101625 A1 May 1, 2008

(51) Int. Cl.
*H04R 25/00* (2006.01)

(52) U.S. Cl. ..... 381/356; 381/358; 381/361

(58) Field of Classification Search ..... 381/91, 381/92, 94.1–94.4, 355, 309, 313, 356–358, 381/365, 173–175, 182, 361; 700/94
See application file for complete search history.

(56) References Cited

U.S. PATENT DOCUMENTS

| | | | | |
|---|---|---|---|---|
| 5,029,216 | A * | 7/1991 | Jhabvala et al. | 381/313 |
| 5,757,933 | A * | 5/1998 | Preves et al. | 381/313 |
| 5,793,875 | A * | 8/1998 | Lehr et al. | 381/313 |
| 7,031,483 | B2 * | 4/2006 | Boone et al. | 381/313 |
| 7,427,819 | B2 | 9/2008 | Hoen et al. | |
| 7,577,262 | B2 | 8/2009 | Kanamori et al. | |

FOREIGN PATENT DOCUMENTS

| | | |
|---|---|---|
| CN | 1797544 | 7/2006 |
| JP | 1994/067691 | 3/1994 |
| JP | 06067691 | 3/1994 |
| JP | 1996/079897 | 3/1996 |
| JP | 08079897 | 3/1996 |
| JP | 2004/187283 | 7/2004 |
| KR | 20/0394796 | 11/2006 |

* cited by examiner

*Primary Examiner* — Suhan Ni

(57) ABSTRACT

Electronic devices and microphone devices are described.

14 Claims, 4 Drawing Sheets

PIEZOELECTRIC MICROPHONES

BACKGROUND

In many electronic applications, one or more microphones may be needed. For example, in communications devices, a microphone is needed to convert an audio signal (e.g., voice) to an electrical signal for transmission to a receiver. One or more additional microphones may be included in the communications device to provide noise cancellation of ambient noise.

Micro-electromechanical systems (MEMS) based microphones have received interest as candidates for various applications. One type of MEMS microphone is a capacitive-based microphone. A capacitive microphone normally includes a fixed plate and a floating plate. Steps must be taken to avoid contact between the plates. This may be accomplished using stand-offs, which maintain a minimum spacing between the plates. In order to provide noise cancellation using capacitive microphones, a rather complex plate structure must be fabricated. As will be appreciated, there are manufacturing complexities and reliability concerns associated with known capacitive microphone structures.

What is needed, therefore, is a microphone structure and an electronic device that address at least the shortcomings described above.

SUMMARY

In accordance with an illustrative embodiment, an electronic device includes a first microphone operative to receive audio signals from a first direction; and a second microphone operative to receive audio signals from a second direction. The device also includes a controller operative to engage selectively the second microphone to receive ambient audio noise or to receive an audio input.

In accordance with another illustrative embodiment, a microphone device includes a first microphone disposed over a substrate and adapted to receive audio signals from a first direction. The microphone device also includes a second microphone disposed over the substrate and adapted to receive audio signals from a second direction.

In accordance with yet another illustrative embodiment, a microphone device includes a first microphone comprising a first film bulk acoustic (FBA) device. The first microphone is adapted to receive audio signals from a first direction. The microphone device also includes a second microphone comprising a second FBA device. The second microphone is adapted to receive audio signals from a second direction.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DEFINED TERMINOLOGY

The terms 'a' or 'an', as used herein are defined as one or more than one.

The term 'plurality' as used herein is defined as two or more than two.

The term 'direction' as used herein is defined as from a particular direction (e.g., along an axis), or from a side of a microphone (e.g., from a general direction), or both.

DETAILED DESCRIPTION

In the following detailed description, for purposes of explanation and not limitation, specific details are set forth in order to provide a thorough understanding of example embodiments according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of hardware, software, firmware, materials and methods may be omitted so as to avoid obscuring the description of the illustrative embodiments. Nonetheless, such hardware, software, firmware, materials and methods that are within the purview of one of ordinary skill in the art may be used in accordance with the illustrative embodiments. Such hardware, software, firmware, materials and methods are clearly within the scope of the present teachings.

Figure 1A:
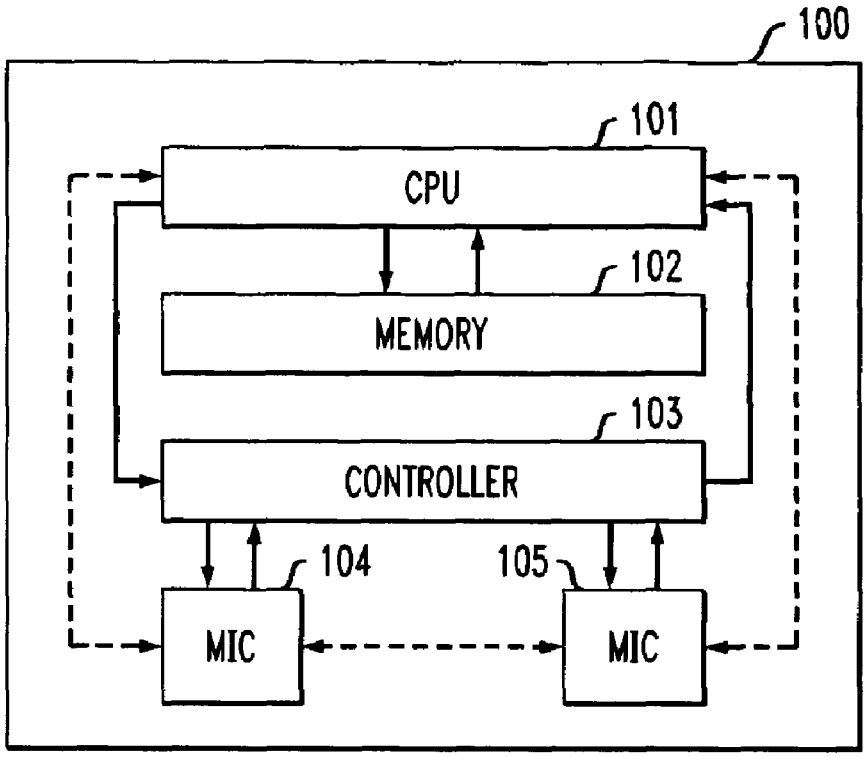
FIG. 1A is a simplified block diagram of an architecture of an electronic device in accordance with a representative embodiment.

FIG. 1A is a simplified block diagram of an architecture of an electronic device 100 in accordance with a representative embodiment. The block diagram includes only those components that are germane to the description of the embodiments described herein. Notably, a number of components that would be implemented in an electronic device that are not required for the description of the embodiments are not shown or described to avoid obscuring the description of the embodiments.

The electronic device 100 may be a hand-held device such as a mobile phone, a camera, a video camera, a personal digital assistant (PDA), a sound recording device, a laptop computer, a tablet computer, a handheld computer, a handheld remote, or a device that comprises the functionality of one or more of these devices. It is emphasized that the noted devices are merely illustrative and that other devices are contemplated. Generally, the electronic device 100 is a device that benefits from a microphone structure having a plurality of microphones, with at least one microphone optionally being adapted to function in more than one mode. In many representative embodiments, the electronic device is portable. However, this is not essential. For example, many electronic devices that are comparatively small in size, but nonetheless not necessarily functional during transit, may benefit from the microphone structure of the illustrative embodiments.

The electronic device 100 includes a central processing unit (CPU) 101, a memory 102, a controller (e.g., Input/Output (I/O)) 103, a first microphone (mic) 104 and a second mic 105. The CPU 101 may be a known microprocessor, and is adapted to provide data to and receive data from the memory 102. As described in further detail herein, the controller 103 provides instruction to the mics 104,105 and receives feedback from the mics; and receives instructions from and provides output to the CPU 101. As shown in dotted arrows, connections between the mics 104,105 and between the mics 104,105 and the CPU 101 are contemplated. These connections may be in addition to or instead of certain connections shown and may be used for a variety of reasons. For example, the connection between the mics 104,105 may be useful in providing analog noise cancellation, such as differential signal cancellation via a known circuit (not shown).

In the representative embodiment of FIG. 1A, only two mics 104,105 are shown. This is merely for facility of description and it is emphasized that more than two (e.g., an array) of mics may be provided in the electronic device 100. As will be appreciated by one of ordinary skill in the art having had the benefit of the present disclosure, the diverse functionality provided by the two mics 104,105 may be readily extended to more than two mics.

In one embodiment, one of the mics 104,105 may be used for active sound input, such as a voice input, and the other mic may be used for background (ambient noise) cancellation. In another embodiment, both mics 104,105 may be used for active sound input, with one mic receiving sound from one direction and one receiving sound from another direction. Thus, the mics 104,105 of the electronic device 100 may be adapted each to provide dual functionality: active sound input and noise cancellation. Thereby, the mics 104,105 provide versatility of function to the electronic device 100.

In the present embodiment, the controller 103 is the controller (I/O) for the electronic device 100, and thus provides control to other functions of the device as well. As details of the controller 103, its requirements and function are well within the purview of one of ordinary skill in the art, such details are omitted to avoid obscuring the present teachings.

In a first representative embodiment, mic 104 is adapted for active sound input and mic 105 is adapted for ambient noise cancellation. For example, if the electronic device 100 were a mobile phone, the mic 104 may be the voice microphone. The mic 105 may be located on a side opposite of the mic 104 to pick up the ambient noise preferentially over the user's voice. The selection of this mode may be by default, with controller 103 providing instructions to the mics 104,105. Alternatively, a user input (not shown) may be used to selectively engage this mode via the CPU 101 and memory 102. Upon selection, the controller 103 provides the commands to the mics 104, 105 to engage in this mode.

Upon activation, the first mic 104 receives the active audio signal, while the second mic 105 receives background noise. The input to the first mic 104 and the second mic 105 are converted into electrical signals that are provided to the controller 103 and to the CPU 101. In a representative embodiment, the CPU 101 is adapted to provide noise cancellation algorithmically. After providing noise cancellation to the signal from the first mic 104, the CPU 101 provides the signal for transmission by the electronic device 100.

In another representative embodiment, the roles of the mics may be reversed. For example, many mobile phones are adapted to record video, such as streaming video. The lens of the camera may be located on a rear surface of the phone allowing the user to view the display while recording. Thus, a microphone located on the rear of the phone may be used to record audio while the camera records video. As such, the second mic 105 may be used to receive active audio signals. Moreover, it may be beneficial to provide noise cancellation of ambient noise to improve the audio signal of the recorded video. In this case, the first mic 104, which is located on the side opposite the lens (and thus the direction being recorded), may be used to receive the ambient noise for further noise cancellation.

In the noted embodiment, upon selection of a video record mode by the user, the controller 103 provides instructions to the mics 104,105 to commence recording. The controller 103 receives the converted signals from the mics 104,105 and provides these to the CPU 101 for processing as noted previously.

In yet another representative embodiment, both mics 104, 105 are used for receiving active audio signals. Continuing with the embodiment that the electronic device 100 is a mobile phone, the first mic 104 may receive the voice active audio signal for telephone transmission, and the second mic 105 may be used for recording an audio signal when the video function of the phone is engaged. In such an embodiment, the second mic 105 may have different audio reception characteristics than the first mic 104 to facilitate audio signal reception of objects at a distance from the phone, or over a wider acceptance angle, or both.

In the noted embodiment, the first mic 104 may be disengaged and the second mic 105 may be engaged when the user selects video recording mode. As before, the controller 103 provides the instructions to the mics 104,105 for selective engagement/disengagement.

Figure 1B:
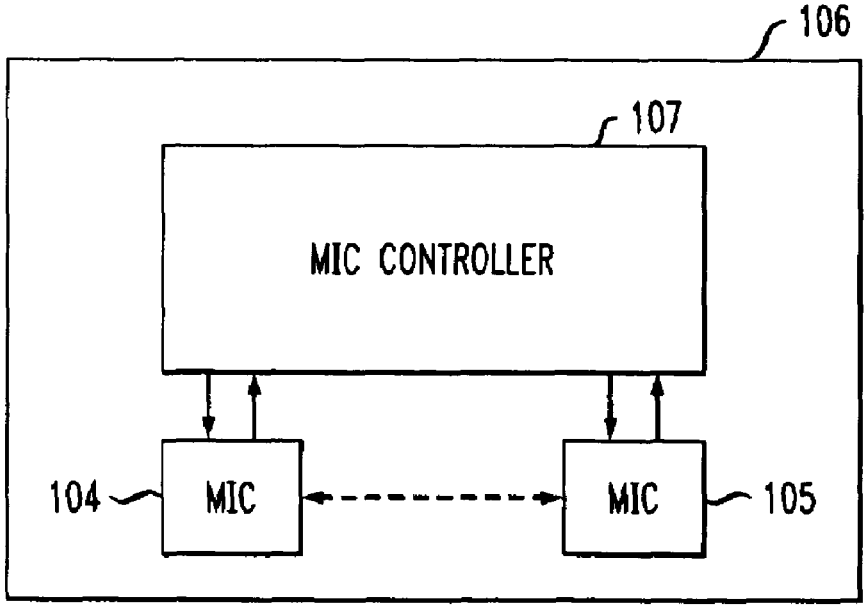
FIG. 1B is a simplified block diagram of an architecture of an electronic device in accordance with another representative embodiment.

FIG. 1B is a simplified block diagram of an architecture of an electronic device 106 in accordance with another representative embodiment. The electronic device 106 of FIG. 1B includes many components described in connection with the embodiments of FIG. 1A. Descriptions of common components and their function are not repeated to avoid obscuring the description of the present embodiments. Moreover, like FIG. 1A, the block diagram of FIG. 1B includes only those components that are germane to the description of the embodiments described herein. Notably, a number of components that would be implemented in an electronic device that are not required for the description of the embodiments are not shown or described to avoid obscuring the description of the embodiments.

The electronic device 106 includes a first mic 104 and a second mic 105. The first mic 104 and the second mic 105 are connected to a MIC controller 107. The MIC controller 107 is a dedicated controller for the mics 104, 105. As will be described herein, the MIC controller 107 provides instructions to the mics 104,105 and is adapted to process signals from the mics 104,105. In an illustrative embodiment, the MIC controller is a microcontroller, such as a Harvard architecture microprocessor; and may be an application specific integrated circuit (ASIC). It is emphasized that the noted microprocessor is merely illustrative and that other microcontrollers are contemplated.

Like the embodiments described in connection with FIG. 1A, the mics 104,105 are adapted to provide diverse functionality to the electronic device 106. For example, one mic may be adapted to receive active audio signals, while the other may be adapted to receive ambient noise signals. Alternatively, both mics 104,105 may be adapted to receive active audio signals. Moreover, there may be more than two mics provided in the device, providing active audio and ambient noise signal reception.

The noise cancellation function of the electronic device 106 may be effected via noise cancellation algorithms of the MIC controller 107. Alternatively, analog noise cancellation, such as differential signal cancellation could be implemented.

Figure 2A:
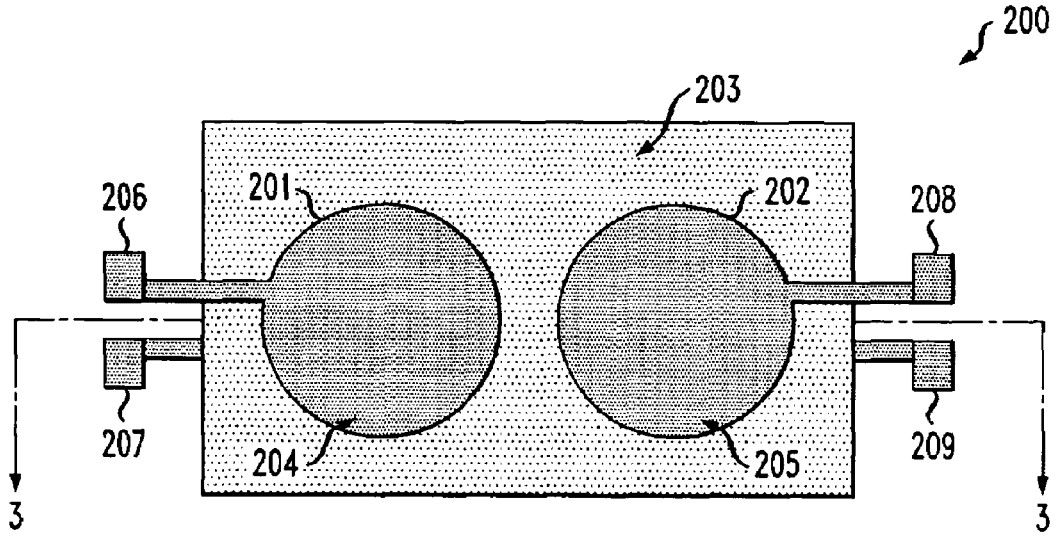
FIG. 2A is a top view of a microphone device in accordance with a representative embodiment.

FIG. 2A is a top view of a microphone device 200 in accordance with a representative embodiment. The microphone device 200 may be disposed in electronic device 100 or electronic device 106 and provide the first and second mics 104,105.

The microphone device 200 includes a first mic 201 and a second mic 202. As before, more than two mics may be provided in the microphone device 200. A first lower electrode (not shown in FIG. 2A) of the first mic 201 is provided over a substrate (not shown in FIG. 2A); and a second lower electrode (also not shown in FIG. 2A) of second mic 202 is provided over the substrate. A layer of piezoelectric material 203 is provided over the first electrodes and the substrate. A first upper electrode 204 for the first mic 201 is provided over the layer of piezoelectric material 203. A second upper electrode 205 for the second mic 202 over the layer of piezoelectric material 203. Finally, contacts 206, 207 provide electrical connections to the first mic 201 and contacts 208, 209 provide electrical connections to the second mic 202.

It is noted that the first and second mics 201, 202 as well as other mics described herein may be film bulk acoustic (FBA) devices; and may be fabricated using methods and materials useful in fabricating film bulk acoustic resonator (FBAR) devices, which are well-known to one skilled in the art. The FBA mics of the representative embodiments are similar to FBAR devices but differ in their function. In particular, the mics of the present embodiments are not electrically driven and thus normally will not resonate.

Alternatively, the architecture of the representative embodiments described herein may include mics based on other technologies. For example, electret-based mics may be incorporated to realize the microphone device 200.

Figure 2B:
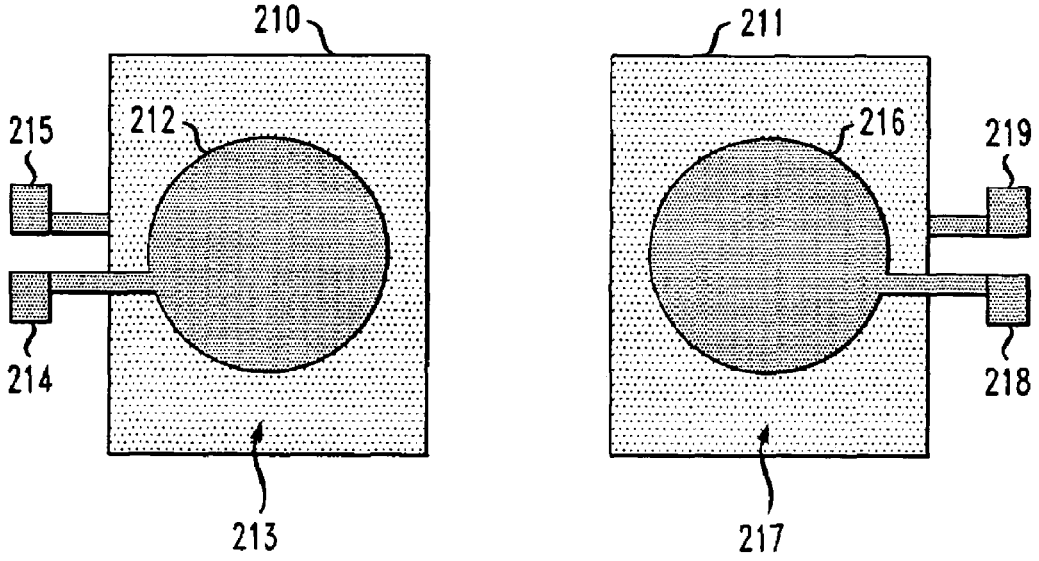
FIG. 2B is a top view of a microphone device in accordance with a representative embodiment.

FIG. 2B is a top view of a first mic 210 and a second mic 211 in accordance with another representative embodiment. The first and second mics 210, 211 are substantially the same as first and second mics 201, 202, respectively. However, the first and second mics 210, 211 are separate devices, each formed over respective substrates (not shown). Moreover, and as will become clearer as the present description continues, the first and second mics 210, 211 may be individually packaged.

First mic 210 has a first upper electrode 212 disposed over a first piezoelectric layer 213. As before, the first piezoelectric layer 213 is disposed over the substrate and the first lower electrode (not shown) of the first mic 210. Contacts 214, 215 connect to the first upper and lower electrodes, respectively. Second mic 211 has a second upper electrode 216 and a second lower electrode (not shown in FIG. 2B). A second piezoelectric layer 217 is disposed over the substrate and the second lower electrode. Contacts 218, 219 connect to the second upper and lower electrodes, respectively.

The individual first and second mics 210, 211 are adapted to function as the plurality of mics 104,105 described previously. In addition, there may be more than two individual mics according to the present teachings implemented in electronic devices 100, 106, for example, and to realize various functionalities. Furthermore, the individual first and second mics 210, 211 may have a structure and be fabricated according to the methods described in connection with FIGS. 3 and 4.

Figure 3:
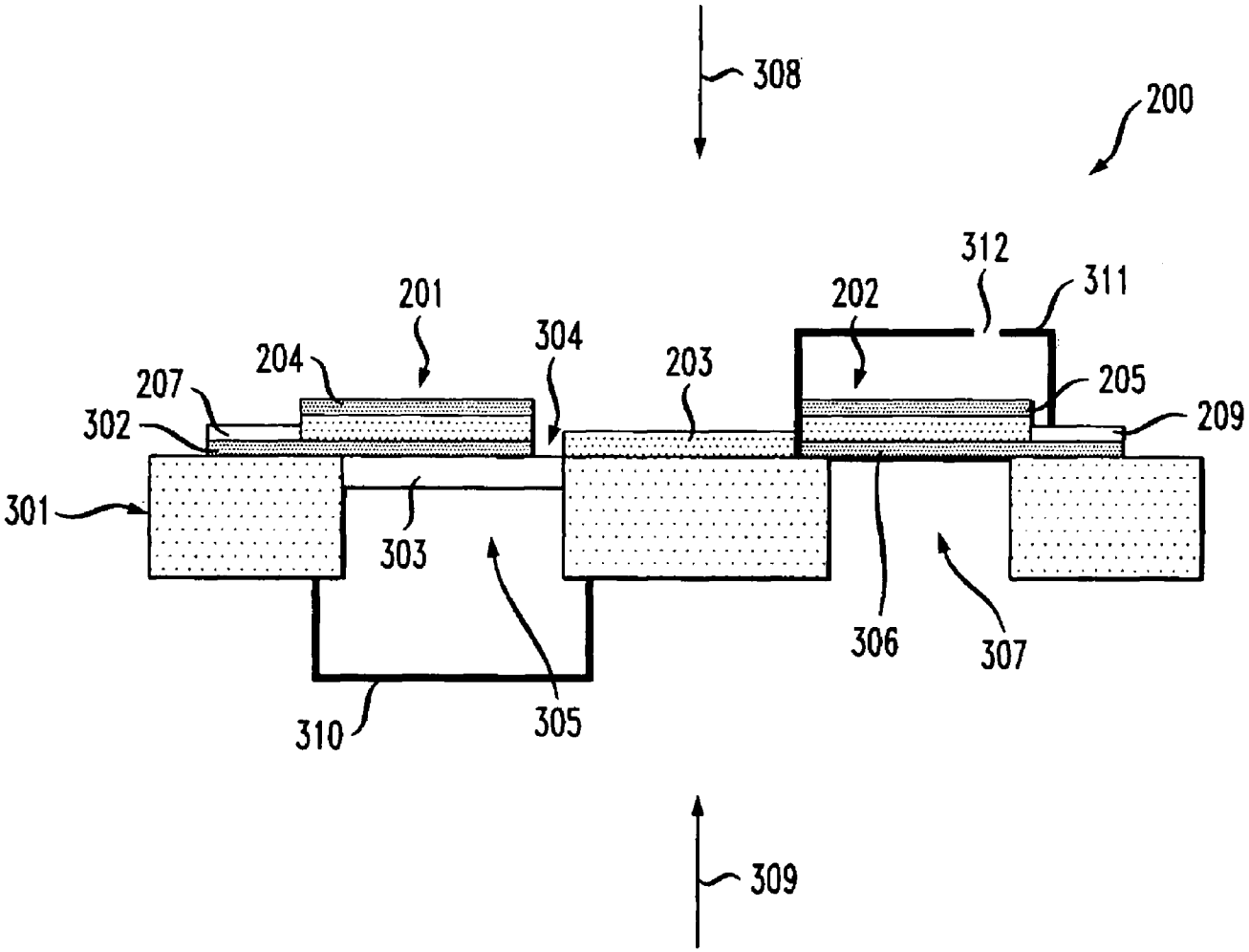
FIG. 3 is a cross-sectional view of the microphone device of FIG. 2A.

FIG. 3 is a cross-sectional view of the microphone device 200 of FIG. 2A taken along the line 3-3. In the present representative embodiments, a plurality of mics is provided over a single substrate. In other embodiments, each of a plurality of mics may be disposed over a respective substrate, such as shown in FIG. 2B. Although the embodiments of FIG. 2B are not shown in cross-section herein, the structures and fabrication sequences described in connection with the embodiments of FIG. 3 are applicable to single mic/single substrate embodiments. Moreover, and as will be appreciated by one skilled in the art, after mass fabrication over a single substrate (wafer), a plurality of mics, each disposed over a respective substrate may be fabricated by dicing or otherwise singulating the wafer.

The microphone device 200 includes a substrate 301, which may be one of a variety of materials. A first lower electrode 302 is disposed over the substrate 301 and partially over a cavity 305, which includes a vent 304. The vent 304 may be provided as a release conduit used to remove sacrificial layer 303 used to form the cavity 305. As described more fully herein, the vent 304 provides pressure equalization for the cavity 305.

The layer of piezoelectric material 203 is disposed over the first lower electrode 302 and the first upper electrode 204 is disposed over the first lower electrode 302. Accordingly, the first mic 201 comprises an FBA structure that includes the first lower electrode 302, the first upper electrode 204 and the portion of the layer of piezoelectric material 203 therebetween.

A second lower electrode 306 is disposed over a cavity 307 in the substrate 301. The layer of piezoelectric material 203 is disposed over the second lower electrode 306, and the second upper electrode 205 is disposed over the piezoelectric layer. Thus, the second mic 202 comprises an FBA structure that includes the second lower electrode 306, the second upper electrode 205 and the portion of the piezoelectric material 203 therebetween.

It is emphasized that there a variety of fabrication sequences contemplated to realize the microphones of the representative embodiments. For example, the lower electrodes may be fabricated independently or simultaneously; the piezoelectric layer may be disposed over the lower electrodes independently or simultaneously; and the upper electrodes may be fabricated independently or simultaneously. Moreover, passivation layers (not shown) may or may not be included.

Without acoustic isolation, the first and second mics 201, 202 are adapted to vibrate in response to audio signals from both directions 308, 309. Notably, the removal of a portion of the substrate 301 to provide the cavities 305, 307 results in vibration of the membranes of the first and second mics 201, 202 from audio signals from directions 308, 309.

If desired, the first and second mics 201, 202 may be unidirectional. In accordance with a representative embodiment, by placing an isolating structure over the first mic 201, or the second mic 202, or both, audio signals from a particular direction may be prevented from vibrating the membranes of at least one of the first and second mics 201, 202. In one embodiment, a first isolation structure 310 provides acoustic isolation and is disposed over the first mic 201; and a second isolation structure 311 provides acoustic isolation and is disposed over the second mic 202. The first isolation structure 310 substantially isolates the first mic 201 from audio signals from direction 309; and the isolation structure 311 substantially isolates the second mic 202 from audio signals from direction 308. Thus, in the representative embodiment shown in FIG. 3, the microphone device 200 is adapted to receive audio signals from direction 308 via the first mic 201 and to receive audio signals from direction 309 via the second mic 202.

The first and second isolation structures 310, 311 may be microcap structures, known to those of ordinary skill in the art. The microcap structure is a known structure and is described, for example, in U.S. Pat. Nos. 6,265,246; 6,376,280; 6,777,267 all to Ruby, et al.; and U.S. Pat. No. 6,777,263, to Gan, et al. The disclosures of these patents are specifically incorporated herein by reference. It is emphasized that the use of a microcap structure to provide directional acoustic isolation is merely illustrative and that other structures are contemplated. For example, the first and second isolation structures 310, 311 may be fabricated in accordance with U.S. patent application Ser. No. 11/540,412 entitled "PROTECTIVE STRUCTURES AND METHODS OF FABRICATING PROTECTIVE STRUCTURES OVER WAFERS" to Frank S. Geefay, et al. This application, filed Sep. 28, 2006, is commonly assigned and is specifically incorporated herein by reference.

Moreover, in order to provide pressure equalization a vent 312 may be provided in the second isolation structure 311. Alternatively, a vent (not shown) similar to vent 304 may be provided.

In certain embodiments, it may be beneficial for substrate 301 to be a semiconductor substrate. This allows for known fabrication methods to be used, and also allows for fabrication of circuits and electronic components from the substrate 301, or over the substrate 301, or both. Accordingly, the substrate may be silicon, SiGe or a III-V semiconductor such as GaAs; although other materials, including for example glass, alumina, and other semiconductor, conductive and nonconductive substrate materials are contemplated.

As will be appreciated, the fabrication of the microphone device 200 allows known processing sequences to be used to form the various features. Methods and materials useful in fabricating the microphone device 200 are generally known to those skilled in very large scale integrated (VLSI) circuit processing arts; and others are known to those skilled in MEMS arts. As many of the noted processing sequences to form the features are known, details are omitted to avoid obscuring the present teachings. It is emphasized that other methods, or materials, or both, which are within the purview of one of ordinary skill in the art, are contemplated. Moreover, it is emphasized that the methods described are applicable to large (wafer) scale fabrication. Accordingly, the microphone devices may have more than two microphones, and a plurality of microphones on a single wafer is contemplated. These wafers may be singulated as desired to provide a multi-microphone device.

The fabrication of the vent 304 may be carried out by providing a sacrificial layer 303 in a cavity etched from the substrate 301. The sacrificial layer 303 may be phosphosilicate glass (PSG). A polishing step, such as chemical mechanical polishing (CMP) may be used to provide a flush surface of the sacrificial layer 303 with the substrate 301 as shown. The components of the first mic 201 may then be formed over the sacrificial layer 303, with the vent 304 being provided for assisting with release/removal of the sacrificial layer 303 and functioning as a vent as noted above.

The sacrificial layer 303 may be used as an etch-stop in a dry-etch sequence or a wet etch sequence used to form the cavity 305. For example, the cavity may be formed using a deep reactive ion etching (DRIE) method such as the known Bosch Method, which is known to provide a comparatively high aspect ratio etch. After the etching of the cavity is completed, the layer 303 is removed through the vent 304 and through the cavity 305 by known methods. Many details of the noted processing sequence may be found in U.S. Pat. No. 6,384,697 entitled "Cavity Spanning Bottom Electrode of Substrate Mounted Bulk Wave Acoustic Resonator" to Ruby, et al. and assigned to the present assignee. The disclosure of this patent is specifically incorporated herein by reference.

The cavity 307 may be formed using a known etching process. Notably, a dry etch (e.g., DRIE) may be used. Alternatively, a wet etch with sufficient etch selectivity may be used. In another embodiment, a sacrificial layer (e.g., PSG, not shown) may be provided beneath the second lower electrode 306. Etching of the cavity 307 ensues, and the sacrificial layer is released simultaneously with the layer 303. Again, these methods are known to those skilled in the art, and are not detailed herein.

As noted previously, the vents 304, 312 are useful in providing pressure equalization. As is known to one of ordinary skill in the art, the cavities 305, 307 are provided to allow the membranes of the first and second mics 201, 202 to vibrate in response to mechanical vibrations (acoustic waves). If the pressure of the ambient changes and the pressure in the cavities does not, the frequency response of the first and second mics 201, 202 may be adversely impacted. Moreover, if the pressure is equalized to the ambient too rapidly, the low-end frequency response of the first and second mics 201, 202 can be deleteriously impacted. As such, a comparatively slow pressure equalization to ambient pressure is desired and fosters a desired frequency response. Notably, the vents 304, 312 function as bleeder holes allowing the pressure equalization to occur comparatively slowly. As one skilled in the art will appreciate, the size of the opening of the vents 304, 312 is selected to provide an appropriate mechanical frequency roll-off for the mics for the particular application of the mics.

The use of semiconductors for the substrate 301 also fosters integration of the microphone device 200 with supporting circuitry, or unrelated circuitry, or both. Among others, the circuits and components contemplated for co-location on the substrate 301 are the components required for signal processing, including noise cancellation. Thus, many components described in connection with FIGS. 1A and 1B and needed for signal processing may be fabricated from the substrate 301. For example, in an embodiment the MIC controller 107 is an ASIC. By the present teachings, the ASIC may be fabricated from the substrate 301, thereby providing a single 'chip' microphone device that includes a plurality of mics, control of the first and second mics 201, 202, and signal processing capability such as described in connection with FIGS. 1A and 1B. Such a device may be further packaged by known methods to provide a microphone device with signal processing capability in a single package.

Alternatively, the microphone device 200 may be instantiated in the substrate 301 and the signal processing (and, optionally other) circuitry may be instantiated in a second substrate (not shown). These two chips may then be packaged by known methods. Thus, the functionality of the components described in connection with the embodiments of FIGS. 1A and 1B may be provided in a single package.

Figure 4:
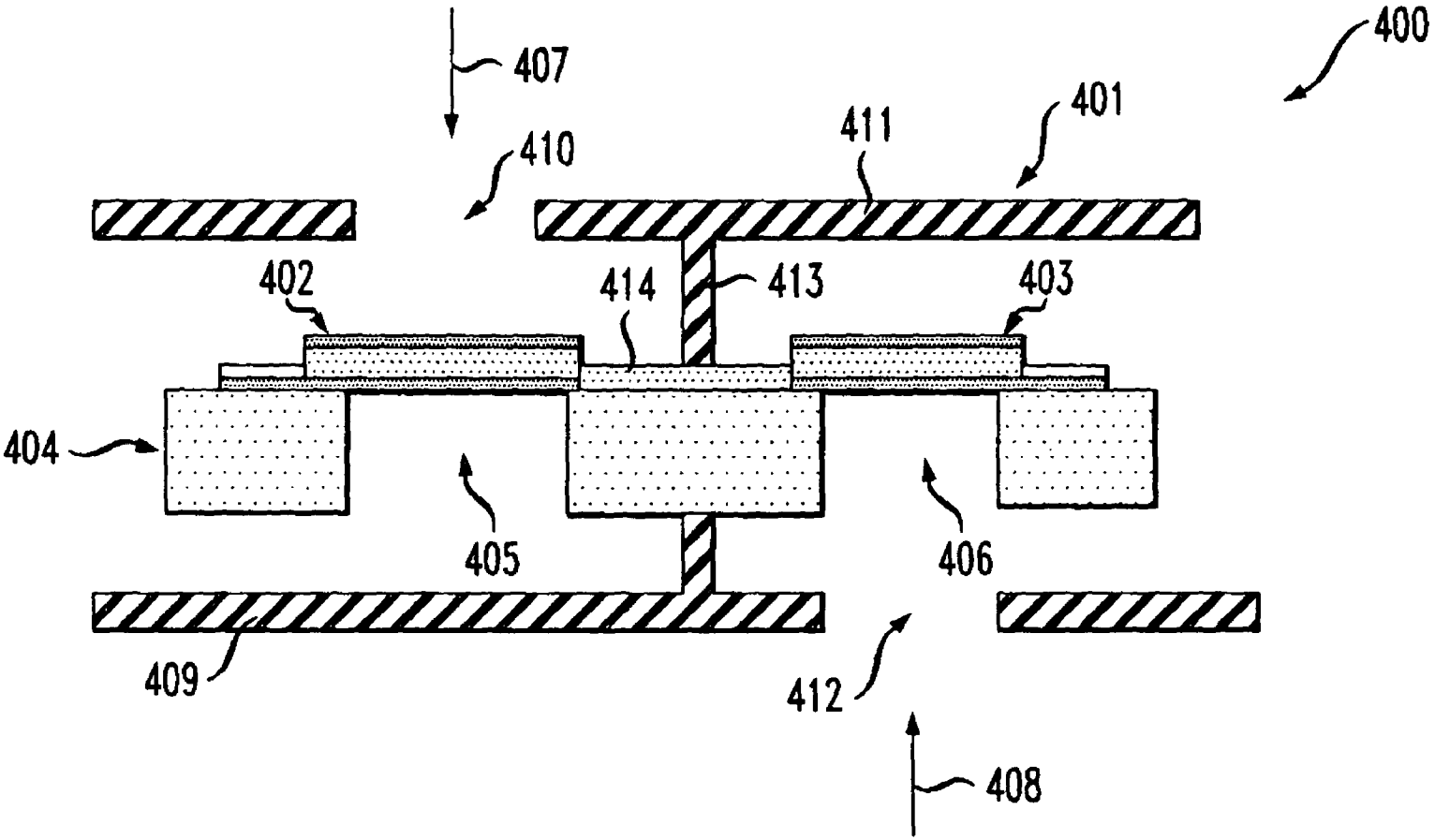
FIG. 4 is a cross-sectional view of a microphone device in accordance with a representative embodiment.

FIG. 4 is a cross-sectional view of a microphone device 400 in accordance with a representative embodiment. The microphone device 400 shares common features with the microphone device 200 described in connection with the illustrative embodiments previously. Moreover, the microphone device 400 may be implemented in electronic devices 100, 106. Many common details are omitted to avoid obscuring the description of the present embodiment.

The microphone device 400 includes a package 401 disposed about a first mic 402 and a second mic 403. In an illustrative embodiment, the package 401 may be a polymer (e.g., plastic) material suitable for use in packaging semiconductor die. In another illustrative embodiment the package 401 may be a microcap package in accordance with the above-referenced patents.

The first mic 402 and second mic 403 each comprise FBA structures provided over substrate 404 as shown. Alternatively, each mic 402, 403 may be provided over a respective substrate. As such, an individual package (not shown) may be provided over each substrate of the individual first and second mics 402, 403. The individual packages for each of the first and second mics 402, 403 may be polymer packages or microcap packages as discussed in connection with package 401. Alternatively, a single package (e.g., package 401, suitably modified) for both first and second mics 402, 403 may be provided.

Cavities 405 and 406 are provided in the substrate 404 and beneath respective FBA structures of first and second mics 402, 403. Additionally, vents (not shown) may be provided to foster suitable pressure equalization. In the present embodiments, the vents are likely similar to vent 304 and are fabricated by similar methods.

In the present illustrative embodiment, the first and second mics 402, 403 are substantially identical, facilitating fabrication. However, the first and second mics 402, 403 may also be substantially identical in structure one or both of the first and second mics 201, 202, described previously. Therefore, without directional acoustic isolation, the first and second mics 402, 403 are both adapted to receive audio signals from more than one direction. As will be appreciated, it is useful in certain applications to provide directional isolation for one or both of the first and second mics 402, 403.

In the present embodiment, the package 401 selectively provides directional reception by appropriate isolation of the first and second mics 402, 403. The first mic 402 is adapted to receive audio signals from a first side or direction 407, and is substantially isolated from audio signals emanating from a second side or direction 408. By contrast, the second mic 403 is adapted to receive audio signals from the second direction 408, and is substantially isolated from audio signals emanating from the first direction 407.

Isolation of the first mic 402 from audio signals of the second direction 408 is provided by a first wall 409 of the package 401; and reception of audio signals from the first direction 407 by the first mic 402 is facilitated by an opening 410 in the package 401. Similarly, isolation of the second mic 403 from audio signals of the first direction 407 is provided by a second wall 411 of the package 401; and reception of audio signals from the second direction 408 by the second mic 403 is facilitated by an opening 412 in the package 401.

As described in connection with the embodiments of FIGS. 2 and 3, the substrate used for the microphone device may be used to provide other circuits, such as signal processing circuits. As such, a packaged microphone device with integrated signal processing circuitry is contemplated by the representative embodiment shown in FIG. 4. Moreover, the microphone device 400 may comprise the substrate 404, and another substrate (not shown) may comprise the signal processing circuitry. These substrates may then be provided in package 401, and thus a packaged microphone device and signal processing circuitry may be provided.

The first and second mics 402, 403 may also be isolated from one another by a barrier 413. The barrier 413 may be formed of the material used for the package 401, although other materials may be used. The barrier 413 usefully prevents acoustic energy from being transmitted between the first and second mics 402, 403. Additional isolation may be realized by providing a gap or break (not shown) in a piezoelectric layer 414.

In connection with illustrative embodiments, piezoelectric microphones and methods of fabricating the microphones are described. One of ordinary skill in the art appreciates that many variations that are in accordance with the present teachings are possible and remain within the scope of the appended claims. These and other variations would become clear to one of ordinary skill in the art after inspection of the specification, drawings and claims herein. The invention therefore is not to be restricted except within the spirit and scope of the appended claims.

The invention claimed is:

1. A microphone device, comprising:

a first microphone disposed over a substrate and adapted to receive audio signals primarily from a first direction; and a second microphone disposed over the substrate and adapted to receive audio signals primarily from a second direction, wherein the first direction and the second direction are opposing, wherein the first microphone comprises a first film bulk acoustic (FBA) structure and the second microphone comprises a second FBA structure.

2. A microphone device as claimed in claim 1, further comprising a plurality of microphones.

3. A microphone device as claimed in claim 1, wherein the audio signals from the first direction are speech signals and the audio signals from the second direction are ambient noise signals.

4. A microphone device as claimed in claim 3, wherein the ambient noise signals are used to provide noise cancellation to an output signal of the first microphone.

5. A microphone device as claimed in claim 1, wherein the audio signals from the first and second directions are speech signals.

6. A microphone device as claimed in claim 1, wherein the substrate is disposed in a package.

7. A microphone device as claimed in claim 6, wherein the package further comprises an acoustic barrier disposed between the first and the second microphones.

8. A microphone device as claimed in claim 6, wherein the package includes a first sound input adapted to receive the audio signals from the first direction and a second sound input adapted to receive the audio signals from the second direction.

9. A microphone device as claimed in claim 1, further comprising a cap structure over the second microphone, wherein the cap structure substantially isolates the second microphone from audio signals from the first direction.

10. A microphone device, comprising:

a first microphone comprising a first film bulk acoustic (FBA) device, wherein the first microphone is adapted to receive audio signals primarily from a first direction; and a second microphone comprising a second FBA device, wherein the second microphone device is adapted to receive audio signals primarily from a second direction, wherein the first direction and the second direction are opposing.

11. A microphone device as claimed in claim 10, further comprising at least a third microphone comprising a third FBA device.

12. A microphone device as claimed in claim 10, wherein the audio signals from the first direction are voice signals and the audio signals from the second direction are ambient audio noise signals.

13. A microphone device as claimed in claim 10, wherein the audio signals from the first and second directions are voice signals.

14. A microphone device as claimed in claim 10, wherein the first microphone is disposed over a first substrate, and the second microphone is disposed over a second substrate.

* * * * *